US006863282B2

(12) United States Patent
Greber et al.

(10) Patent No.: US 6,863,282 B2
(45) Date of Patent: Mar. 8, 2005

(54) INLINE ROLLER SKATE

(76) Inventors: Andreas Greber, Wacholderweg 13, D-87549 Rettenberg (DE); Matthias Wollenberg, Stettiner Weg 5, D-72108 Rottenburg (DE)

( * ) Notice: Subject to any disclaimer, the term of this patent is extended or adjusted under 35 U.S.C. 154(b) by 0 days.

(21) Appl. No.: 10/293,329

(22) Filed: Nov. 14, 2002

(65) Prior Publication Data

US 2003/0098556 A1 May 29, 2003

(30) Foreign Application Priority Data

Nov. 26, 2001 (DE) ..... 201 19 159 U
Dec. 7, 2001 (DE) ..... 201 19 884 U
Sep. 19, 2002 (DE) ..... 102 43 480

(51) Int. Cl.[7] ..... A63C 17/06
(52) U.S. Cl. ..... 280/11.223; 280/11.27
(58) Field of Search ..... 280/11.223, 11.221, 280/11.231, 11.27; 301/5.301, 5.7, 5.305

(56) References Cited

U.S. PATENT DOCUMENTS 4,763,957 A * 8/1988 Poehlmann et al. ..... 301/110.5
5,271,633 A * 12/1993 Hill, Jr. ..... 280/11.223
5,441,286 A * 8/1995 Pozzobon ..... 280/11.27
5,527,050 A * 6/1996 Szendel ..... 280/11.223
5,595,392 A * 1/1997 Casillas ..... 280/7.13
5,716,060 A * 2/1998 Szendel ..... 280/11.223
5,769,432 A * 6/1998 Tybinkowski et al. . 280/11.204
5,775,707 A * 7/1998 Hu et al. ..... 280/11.223
5,800,022 A * 9/1998 Del Rosario ..... 301/5.306
5,882,087 A * 3/1999 Post ..... 301/5.306
5,884,923 A * 3/1999 Pratt ..... 280/11.221
5,941,539 A * 8/1999 Pratt ..... 280/11.27
5,961,130 A * 10/1999 Gorza et al. ..... 280/11.215
5,964,537 A * 10/1999 Hill, Jr. ..... 384/559
5,988,656 A * 11/1999 Krah ..... 280/11.27
6,065,760 A * 5/2000 Weygandt ..... 280/11.19
6,105,976 A * 8/2000 Cottle ..... 280/11.216
6,607,198 B2 * 8/2003 Szendel ..... 280/11.27

* cited by examiner

*Primary Examiner*—Christopher P. Ellis
*Assistant Examiner*—Jeff Restifo
(74) *Attorney, Agent, or Firm*—Hoffman Wasson & Gitler

(57) ABSTRACT

An inline roller skate with a foot receiver, such as a shoe, and with a frame with rollers which is provided on this foot receiver. These rollers, and their axles, are removably mounted on the frame by means of a quick-acting closure.

5 Claims, 3 Drawing Sheets

INLINE ROLLER SKATE

BACKGROUND OF THE INVENTION

The invention relates to an inline roller skate.

Inline roller skates are known in the most varied versions. The object of the invention is to devise an inline roller skate which allows the rollers to be changed quickly, easily, and without a tool.

SUMMARY OF THE INVENTION

In one preferred embodiment, the quick-acting closure clamping system is made such that the respective roller, together with its bearing, can be changed as a complete roller unit.

BRIEF DESCRIPTION OF THE DRAWINGS

The invention is detailed below using the figures.

DETAILED DESCRIPTION OF THE INVENTION

Figure 1:
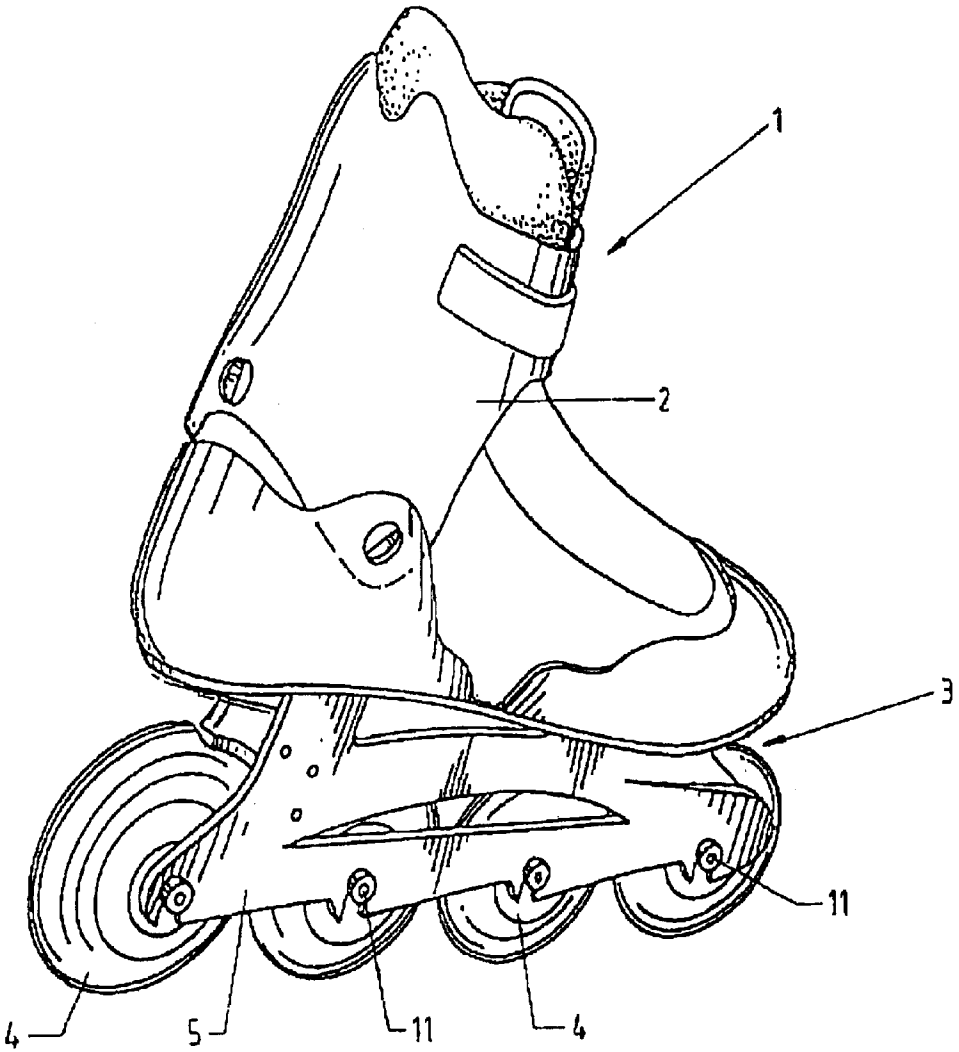
FIG. 1 shows an inline roller skate in a side view.
Figure 3:
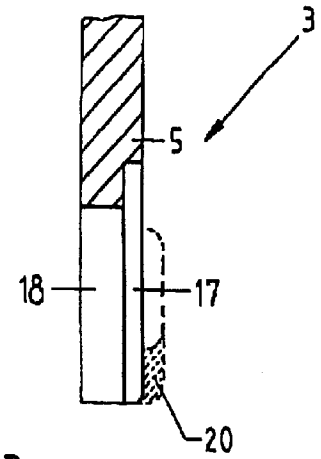
FIG. 3 shows a section according to line I—I of FIG. 2.
Figure 2:
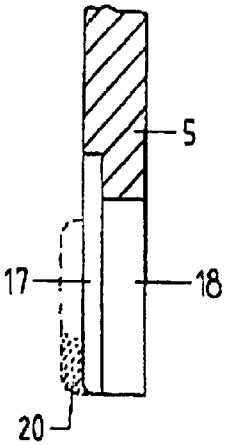
FIG. 2 shows enlarged the holding rail of the frame or chassis in the area of a receiver for a fully floating axle of a detachable roller unit.
Figure 2:
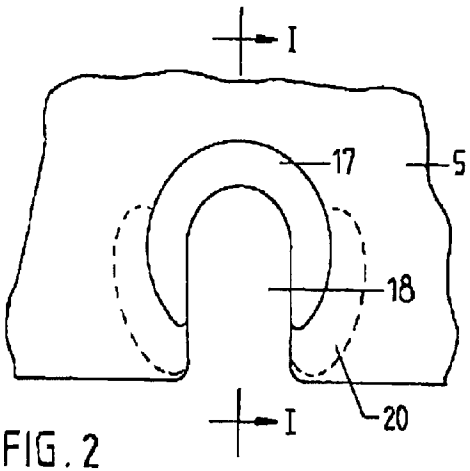

The inline roller skate, which is generally labelled 1 in the figures, is constructed conventionally of a one-part, or multi-part shoe 2, and of a chassis, or frame 3, which is connected to this shoe, and on which, there are several rollers 4, which can turn freely. The rollers 4 are supported between the holding rails 5 of the frame 3, and are each a component of a roller unit 6, which is detachably held on the holding rails 5, as a complete component, by means of a quick-acting closure 7.

Figure 4:
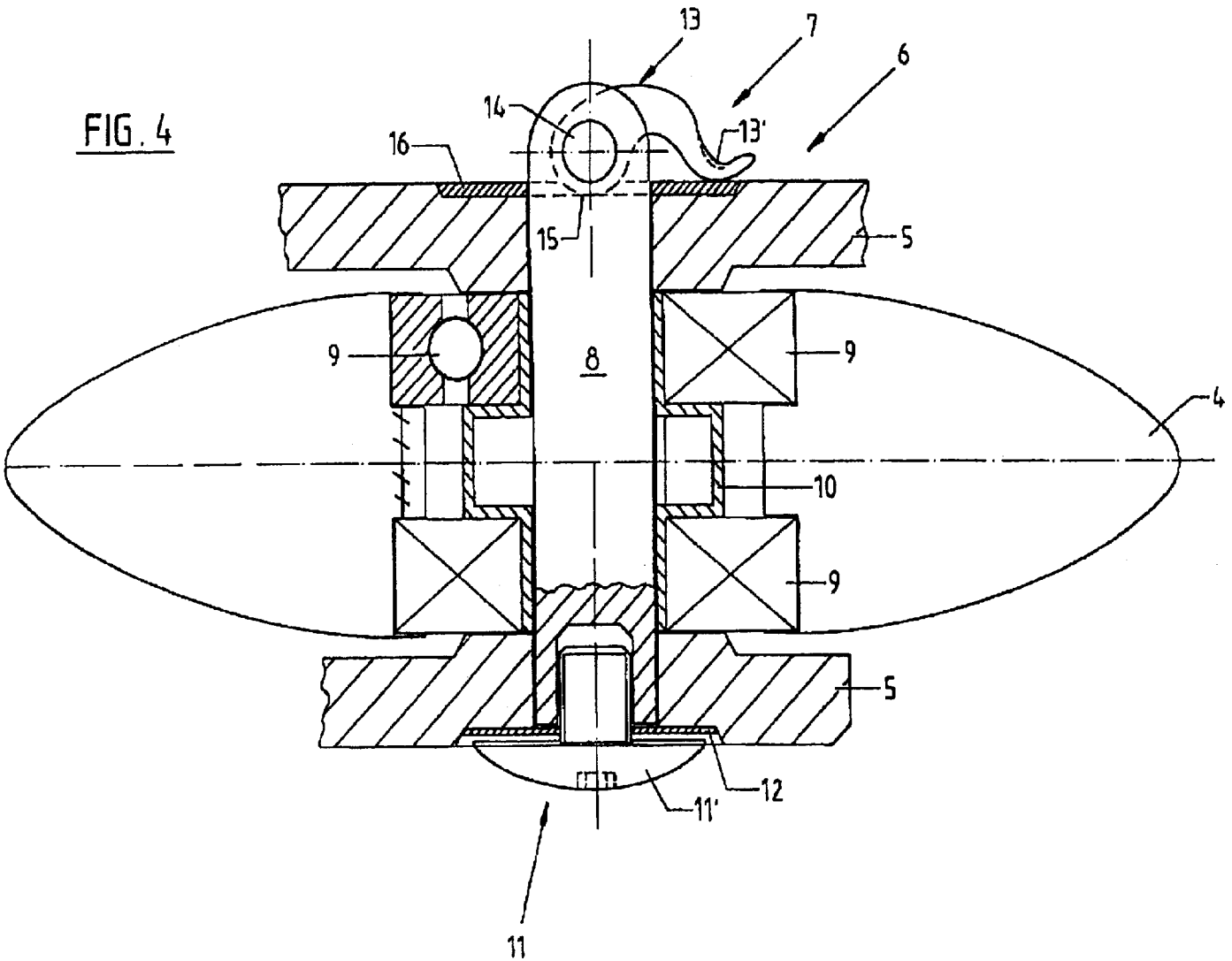
FIG. 4 shows a section through the two holding rails of the frame and through a roller unit which is attached to these holding rails by means of a quick-acting closure.

As FIG. 4 shows, the roller unit includes a shaft 8, on which there are two roller bearings 9, for the respective roller 4, spaced axially apart from one another by a spacer sleeve 10. The shaft 8 on one end has an enlarged-diameter head which is formed, in this embodiment, by the head 11' of a setting screw 11, which is screwed into the threaded hole, located coaxially with the axis of the shaft 8 on this end. Between the end of the shaft 8, and the head 11', there is a shim 12, with a diameter, like the diameter of the head 11, which is greater than the cross section of the shaft 8. On the other end, on the shaft 8, there is a lever-like quick-acting clamping element 13, around the axis radially to the shaft axis, with the capacity to swivel around a threaded pin 14, which has an axis which is oriented radially to the axis of the shaft 8. The clamping element 13 forms two eccentric surfaces 15, which each run eccentrically around this axis and which are offset in the axial direction of the pin 14 against one another. They interact with a strain washer 16, which is located on the end of the shaft 8 there.

The eccentric surfaces 15 interact with the strain washer 16, which has a diameter greater than the diameter of the shaft 8, and in this embodiment, equal to the diameter of the shim 12, such that when the lever-like clamping element 13 is swivelled into the position in which this clamping element rests, with its lever arm 13' against the strain washer 16, a tensile or clamping force which anchors the roller unit 6, on the frame 4, is applied to the shaft 8, via this strain washer, which is supported on the holding rail 5. This clamping force clamps the two ball bearings 9, with their rings, which sit on the sleeve 10 and also the sleeve itself, between the inner sides of the holding rails 5, which sides face one another. The shim 12, or the head 11', and the strain washer 16, are each held by interlocking in a recess 17 which is formed on the outer side of the pertinent holding rail 5. The recesses 17 are made such that with their edge, they surround the respective shim 12, or washer 16, over a peripheral range of greater than 180° by interlocking.

In the area of each recess 17, the pertinent holding rail 5 has a slot 18, into which the shaft 8 can be pushed radially to its axis when the clamping element 13 is not tensioned, such that the respective holding rail 5 is located between the ball bearing 9, and one shim 12, or washer 16. When the clamping element 13 is tensioned, then the pertinent shim, or washer, is pressed into the recess 17, and anchored by interlocking there, with bracing of the ball bearings and the spacer sleeve 10 between the holding rails 5. The slots 18 are open towards the bottom of the holding rails 5 and extend essentially perpendicular to this bottom. The width of each slot 18 corresponds to the outside diameter of the shaft 8. The length of each slot 18 is chosen such that the shaft 8, which is supported against the end of the slot 18 with its axis, is coaxial to the axis of the circular recesses 17.

The screw 11 also acts as a setting screw with which the distance between the head 11', or the shim 12, and the clamping element 13, can be adjusted depending on the width of the frame 3, or the distance of the outside surfaces of the holding rails 5, such that bracing is achieved in the optimum manner.

Figure 5:
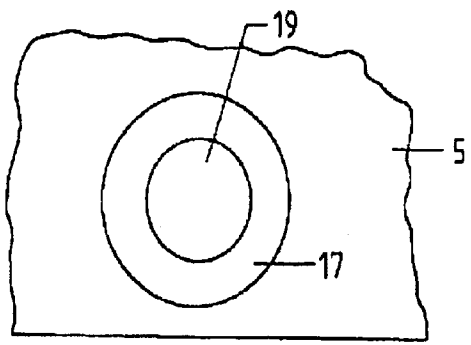
FIG. 5 shows in a view similar to FIG. 2 a receiving opening for axles or shafts in another possible embodiment.

It was assumed above that the respective roller unit 6 can be attached to the frame 4 as an entire component, with the quick-acting closure 13 and can be removed again from it. But, according to FIG. 5, it is also possible to provide holes 19 in the holding rails for supporting the shaft 8. To mount, the roller unit 6, the respective roller 4 with the ball bearings 9, and the spacer sleeve 10, which carries these ball bearings, is positioned between the two holding rails 5 and the shaft 8 with its end away from the clamping element without the screw 11 there, and the shim is pushed axially through the holes 19 and the spacer sleeve 10. Then the shim 12 and the screw 11 are mounted and then the roller unit 6 is finally fixed by tensioning the clamping element 13.

Other versions are also conceivable. Furthermore, other versions of the respective clamping element or quick-acting closure are also conceivable. For example, the form of clamping elements, or clamping systems, can be by means of ramps, inclined planes, but also catch or snap connections.

As is indicated in the figures, it is a good idea on the outside of the holding rails 5 to provide a bead 20 which at least partially surrounds the respective recess 17, such that this bead reliably secures the respective shaft 8 and thus the respective roller unit 6, on the frame 3, at least with the quick-acting closure 7 locked via the shim 12 and washer 16.

Furthermore, it is possible to make the respective roller unit 6 such that it can only be removed when after swivelling the clamping lever 13 into the nonlocking position. The setting screw 11 is also loosened so that the shim 12 of the roller unit 6 can move past the beads 20. They represent an additional safety aspect, since even if tensioning of the clamping lever 13 has been forgotten or the clamping lever

13 is opened because of carelessness or under other circumstances, the roller unit 6 cannot fall out of the frame 3.

Furthermore, instead of a screw 11, the contact surface can be implemented differently.

Reference Number List

1 inline roller skate
2 shoe
3 frame
4 roller
5 holding rail
6 roller unit
7 quick-acting closure
8 shaft
9 ball bearing
10 spacer sleeve
11 setting screw
12 shim
13 clamping lever
13' lever arm
14 hinge pin
15 eccentric surface
16 strain washer
17 recess
18 slot
19 hole

What is claimed is:

1. An inline roller skate comprising:

a foot receiver and a frame which is provided on the receiver, a plurality of roller units attached to the frame and each roller unit comprising a shaft and a roller supported and freely rotatable on said shaft, a quick-acting closure clamping system comprising a clamping lever having at least one eccentric surface pivotally mounted on one end of the shaft of each roller unit, an axially adjustable bearing surface on the other end of the shaft of each roller unit, supporting openings on the frame for ends of each shaft, said supporting openings being laterally open for inserting and removing each roller unit radically to the shaft, two washers on each shaft, one of said washers positioned in between the frame and the eccentric surface of the clamping lever and the other washer positioned in between the frame and the axially adjustable bearing surface, the frame being formed with recesses and beads along said supporting openings wherein, after locking the roller unit by the quick-acting closure, each washer is received in one recess and is fixed in this recess preventing the shaft from moving out of the supporting opening, wherein the recesses have an edge interlocking over a peripheral edge of the washers in a range greater the 180 degrees and said each bead at least partially surrounds the respective recess.

2. The inline roller skate as claimed in claim 1, wherein the roller unit further comprises at least two axially offset ball bearings which are located on a support or spacer sleeve and wherein the axle which is detachably mounted by means of the quick-acting closure extends through the support or the spacer sleeve.

3. The inline roller skate as claimed in claim 1 wherein the frame has a pair of holding rails, the quick-acting closure is made such that in a locked state of the quick-acting closure, at least one bearing of the respective roller is clamped between the holding rails of the frame.

4. Inline roller skate as claimed in claim 1, wherein the axially adjustable bearing surface is formed by the head of a screw engaging a screw thread provided in the shaft on said other end.

5. Inline roller skate according to claim 1, wherein each roller unit comprises at least one ball bearing, and wherein the shaft is located within an inner ring of the ball bearing.

* * * * *